United States Patent [19]

Smith

[11] Patent Number: 4,690,273

[45] Date of Patent: Sep. 1, 1987

[54] TWIN MATCHBOOK

[76] Inventor: Leon E. Smith, 740 Ranch Dr., Toledo, Ohio 43607

[21] Appl. No.: 833,186

[22] Filed: Feb. 26, 1986

[51] Int. Cl.[4] ..... A24F 27/00

[52] U.S. Cl. ..... 206/105; 206/96; 206/104

[58] Field of Search ..... 206/96, 104, 105, 121, 206/457; 150/145, 147; 44/43, 44

[56] References Cited

U.S. PATENT DOCUMENTS

| | | | |
|---|---|---|---|
| 1,573,946 | 2/1926 | Stern . | |
| 1,862,151 | 6/1932 | Langley . | |
| 2,033,332 | 3/1936 | Ferguson | 206/185 |
| 2,140,241 | 12/1938 | Linker | 206/104 |
| 2,259,686 | 10/1941 | Eyer . | |
| 2,344,210 | 3/1944 | Macbeth . | |
| 2,392,991 | 1/1946 | Macomber | 206/457 |
| 2,526,833 | 10/1950 | Sweeney . | |
| 2,606,589 | 8/1952 | Linchan | 150/145 |
| 2,674,290 | 4/1954 | Thomas | 150/145 |
| 2,825,448 | 3/1958 | Myers | 206/104 |
| 3,081,866 | 3/1963 | Diamant . | |
| 3,199,667 | 8/1965 | Todd . | |
| 3,255,868 | 6/1966 | Kowarsky . | |
| 3,334,730 | 8/1967 | Sternau . | |
| 3,866,748 | 2/1975 | Manning, Jr. | 206/105 |
| 4,154,337 | 5/1979 | Tybie . | |

FOREIGN PATENT DOCUMENTS

| | | | |
|---|---|---|---|
| 933230 | 4/1948 | France | 206/104 |
| 28924 | 3/1908 | Sweden | 206/121 |
| 159736 | 4/1933 | Sweden | 206/104 |
| 359199 | 10/1931 | United Kingdom | 206/105 |
| 420173 | 11/1934 | United Kingdom | 206/105 |

*Primary Examiner*—Stephen Marcus
*Assistant Examiner*—David T. Fidei
*Attorney, Agent, or Firm*—Harvey B. Jacobson; Clarence A. O'Brien

[57] ABSTRACT

A pair of parallel elongated flexible panel portions embracingly receive a pair of flat matchbook bundles therebetween with the bundles arranged with the end ends of the bundles spaced apart and the base ends of the bundles extending in opposite directions, the bundle base ends being secured between corresponding ends of the panels. The head ends of the bundles are spaced apart sufficiently to enable the longitudinal midportions of the panels to be appreciably bowed away from each other and opposite marginal edges of the midportions of the panel members have outwardly opening notches formed therein.

7 Claims, 5 Drawing Figures

TWIN MATCHBOOK

BACKGROUND OF THE INVENTION

1. Field of the Invention

This invention relates to a matchbook incorporating two bundles of paper matches and constructed in a manner whereby ready access to the paper matches may be obtain without opening the matchbook, in the usual sense, in order to gain access to the matches.

The subject matter of the instant invention is believed to be classified in Class 206, subclasses 96 and 104–118.

2. Description of Related Art

Various different forms of matchbooks including some of the general structural and operational features of the instant invention are disclosed in U.S. Pat. Nos. 438,166, 1,573,946, 1,862,151, 2,033,332, 2,259,686, 2,344,210, 2,526,833, 3,081,866, 3,199,667, 3,255,868, 3,334,730 and 4,154,337. However, these previously known devices do not include the overall combination of the instant invention which enables a pair of paper match bundles to be supported relative to each other in spaced relation between flexible cover panels and also in a manner whereby access may be gained to any of the paper matches independent of swinging of one of the cover panels toward an open position, in the usual sense.

SUMMARY OF THE INVENTION

Two substantially conventional bundles of paper matches are provided and disposed in spaced opposing relation in the same plane with the chemically treated scratch ignitable head ends of the matches of the two bundles of matches in spaced apart opposing relation. A pair of flexible opposite side cover panels extend between the remote ends of the match bundles and have their opposite ends secured to the binder strips from which the base ends of the paper matches of the match bundles are supported. The cover panels are permanently secured to the binder strips and may have chemically treated scratch surfaces disposed on the outer sides thereof.

In order to enable ready access to the head ends of the matches disposed between the panels, the opposite ends of the matchbook are displaced toward each other in a manner to outwardly bow the opposite side panels of the matchbook and thereby increase the spacing between the longitudinal midportions of the panels which extend between the match head ends of the match bundles. In addition, one side edge of the longitudinal midportion of each flexible panel is notched to facilitate finger digit access to the area between the head ends of the match bundles and the notches of the panels are disposed on opposite longitudinal edges thereof.

The main object of this invention is to provide a thin matchbook which may be readily carried in the pockets or purses of various persons and which will afford a greater number (twice) of paper matches in a given matchbook.

Another important object of this invention is to provide a matchbook construction which will obviate the necessity of swinging open one panel of the matchbook cover to remove a match to be ignited as well as the safety precaution of closing that panel of the matchbook cover before igniting the removed match.

Yet another object of this invention is to provide a matchbook including cover panels of substantially twice the plan area of conventional matchbook cover panels to thereby increase the advertising area available on each matchbook.

Still another object of this invention is to provide an improved matchbook construction wherein a matchbook containing twice the usual number of matches is provided, the advertising space available on the matchbook cover panels is sustantially doubled and each matchbook may be produced from substantailly the same components utilized to construct a pair of conventional matchbooks.

A final object of this invention to be specifically enumerated herein is to provide an improved twin matchbook construction in accordance with the preceding objects and which will conform to conventional forms of manufacture, be of simple construction and easy as well as safe to use so as to provide a device that will be economically feasible and more safe to use than a conventional matchbook.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
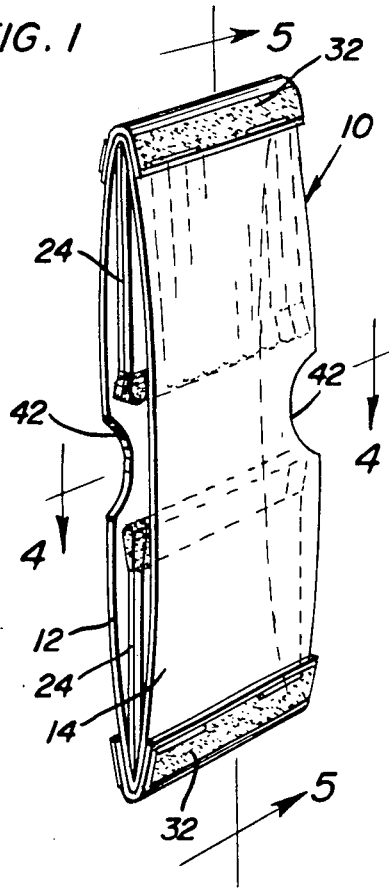
FIG. 1 is a perspective view of the twin matchbook of the instant invention.

Referring now more specifically to the drawings, the numeral 10 generally designates the twin matchbook of the instant invention. The matchbook includes a pair of elongated, substantially straight parallel and flexible opposite side cover panels 12 and 14. The cover panels 12 and 14 may be joined at only one pair of corresponding ends as at 16 or at both pairs of corresponding ends as at 16 and 18. Of course, if the panels 12 and 14 are joined at both 16 and 18, the panels 12 and 14 will comprise opposite side portions of a flattened tubular member.

The matchbook 10 includes a pair of bundles 20 and 22 of paper matches 24 including integrally formed base ends 26 and chemically treated scratch ignitable head ends 28. A binder strip 30 is used at each end of the matchbook 10 to secure the base ends 26 and the corresponding ends of the cover panels 12 and 14 together. The binder strips 30 each may include one or two chemically treated scratch strips 32 supported therefrom against which the head ends 28 of the matches 24 may be scratched in order to ignite the head ends 28.

Suitable staples 36 may be utilized to secure all of the components at each end of the matchbook 10 together and each cover panel 12 and 14 includes a first longitudinal edge 40 which is notched as at 42 centrally intermediate its opposite ends, the other edges 44 of the cover panels 12 and 14 not being notched.

Figure 2:
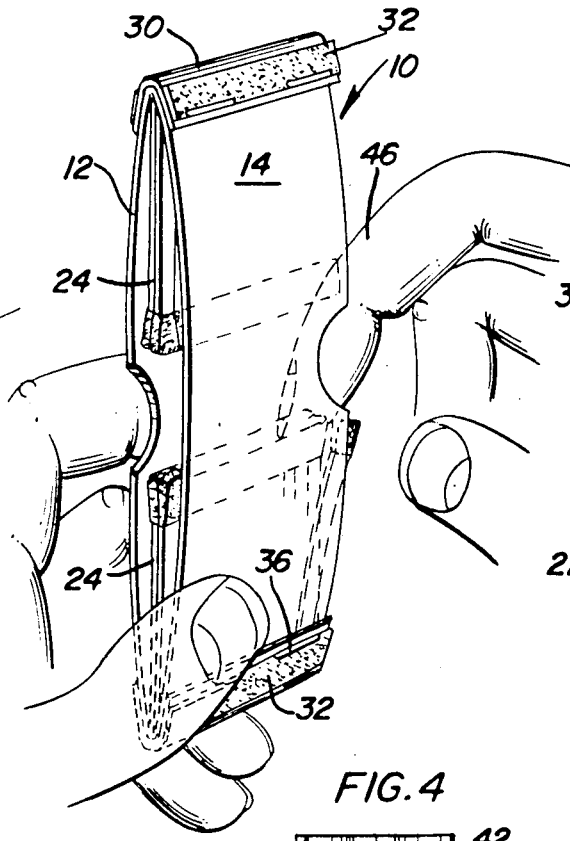
FIG. 2 is a further perspective view of the matchbook illustrating one manner in which access may be had to the head ends of paper matches within the book independent of the usual swinging of a flexible cover panel portion of a matchbook to the open position.
Figure 5:
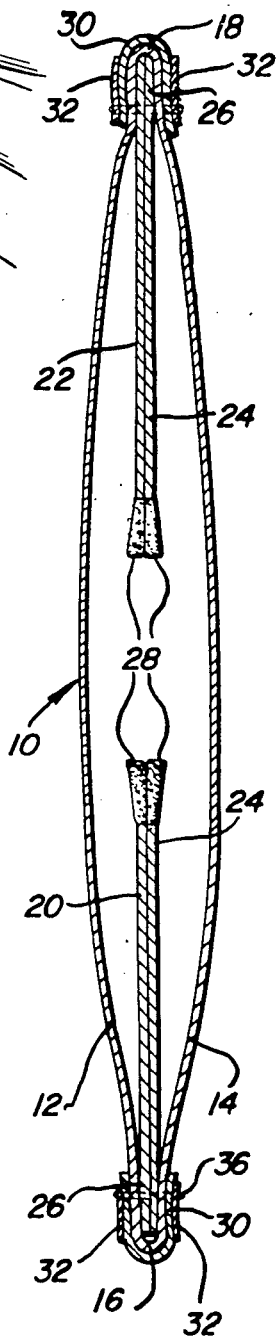
FIG. 5 is an enlarged vertical sectional view taken substantially upon the plane indicated by the section line 5—5 of FIG. 1.
Figure 4:
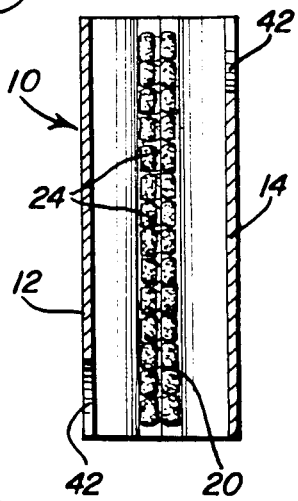
FIG. 4 is an enlarged horizontal sectional view taken substantially upon the plane indicated by the section line 4—4 of FIG. 1.

As best be seen from FIG. 5 of the drawings, when the cover panels 12 and 14 generally parallel each other, the head ends 28 of the match bundles 20 and 22 are spaced sufficiently apart to enable the match bundles 20 and 22 to be displaced toward each other to outwardly bow the longitudinal mid-portions of the panels 12 and 14 apart, while the match head ends are still spaced apart, to allow a finger digit such as the digit 46 illustrated in FIG. 2 to be inserted into the matchbook 10 between the bundles 20 and 22 in order to "pluck" a paper match 24 from one of the bundles preparatory to scratching the head end of that match upon one of the strips 32 in order to ignite the match.

Figure 3:
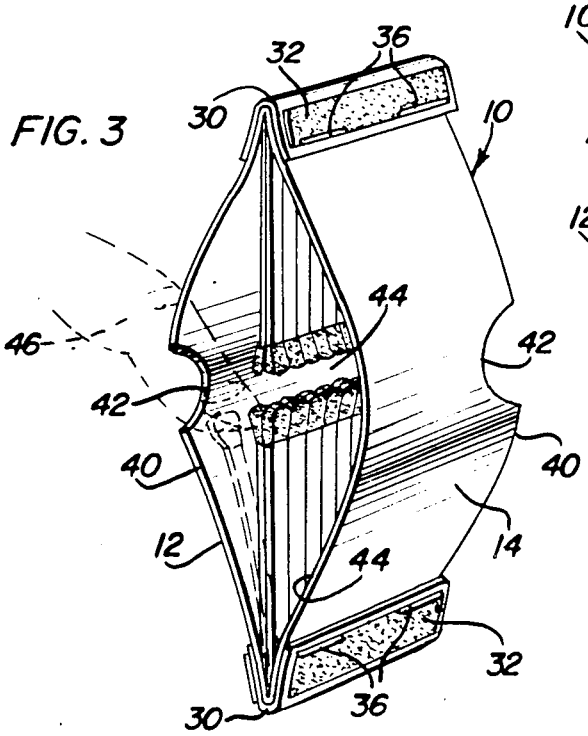
FIG. 3 is a perspective view of the matchbook illustrating a further manner of gaining digital access to the head ends of paper matches within the matchbook.

However, if the hand digit 46 is wider than normal, the opposite ends of the matchbook 10 may be displaced toward each other in order to outwardly bow the longitudinal midportions of the cover panels 12 and 14 in the manner illustrated in FIG. 3 of the drawings. In this manner, additional space is provided for a hand digit 46 to "pluck" a paper match 24 from either of the bundles 20 and 22.

Inasmuch as the panels 12 and 14 are never "opened" in the conventional sense, the head ends of the matches 24 may be ignited by rubbing friction with the panels 32 in a manner which substantially eliminates any possibility of the match heads 28 remaining between the panels 12 and 14 from becoming ignited.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A twin matchbook including a pair of axially aligned match bundles each incorporating a plurality of side-by-side elongated match members including chemically treated scratch ignitable head ends and base ends, the base ends of the match members of each bundle being removably jointed to a corresponding binder strip and each bundle including side-by-side parallel rows of match members with said binder strip extending transversely of the rows, said bundles being arranged in spaced relation with the head ends of the bundles axially opposing each other and the base ends of bundles facing in opposite directions, first and second substantially straight elongated panel means extending lengthwise between said bundles and interconnecting pairs of corresponding opposite ends of said binder strips, said panel means extending along and overlying opposite sides of said bundles with said bundles sandwiched between said panel means, the head ends of the match members of said bundles being spaced apart sufficiently to enable said binder strips and bundles to be displaced toward each other sufficient to allow the longitudinal mid-portions of said panel means to be appreciably bowed apart for the reception of a user's finger between said bowed apart panel mid-portions while the match heads of the bundles are still spaced apart.

2. The matchbook of claim 1 wherein said panel means are integrally formed.

3. The matchbook of claim 1 wherein at least the longitudinal midportions of opposite sides margin edges of said panel means have outwardly opening notches formed therein.

4. A twin matchbook comprising a pair of flat match bundles including interconnected base ends and separate chemically treated scratch ignitable head ends, said bundles being arranged in axial opposing relation with the head ends thereof spaced apart and the base ends extending in opposite directions, a pair of elongated, substantially straight and laterally spaced apart parallel matchbook cover panels overlying opposite sides of said bundles and interconnecting pairs of corresponding opposite base ends of said bundles said head ends of said bundles being spaced apart sufficiently to enable said bundles to be displaced toward each other sufficient to allow the longitudinal mid-portions of the cover panels to be appreciably bowed apart for the reception of a user's finger between said bowed apart panels while the match head ends of the bundles are still spaced apart.

5. The matchbook of claim 4 wherein the spacing between the head ends of said bundles is between $\frac{1}{4}$ and $\frac{1}{3}$ the length of one of said bundles.

6. The matchbook of claim 5 wherein said panels are integrally formed.

7. The matchbook of claim 4 whrein the longitudinal midportions of one pair of remote longitudinal edges of said panels have laterally outwardly opening notches formed therein.

* * * * *